US008439355B2

(12) United States Patent
Ikeda

(10) Patent No.: US 8,439,355 B2
(45) Date of Patent: May 14, 2013

(54) SHEET FEEDER HAVING MOVABLE SUPPORTER FOR SUPPORTING SHEETS STACKED ON A SHEET TRAY AND IMAGE RECORDER HAVING THE SAME

(75) Inventor: Akihiro Ikeda, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 314 days.

(21) Appl. No.: 12/730,446

(22) Filed: Mar. 24, 2010

(65) Prior Publication Data

US 2010/0244367 A1 Sep. 30, 2010

(30) Foreign Application Priority Data

Mar. 31, 2009 (JP) ..... 2009-085701

(51) Int. Cl.
*B65H 3/52* (2006.01)

(52) U.S. Cl.
USPC ..... 271/124

(58) Field of Classification Search ..... 271/121, 271/124
See application file for complete search history.

(56) References Cited

U.S. PATENT DOCUMENTS

| | | | | |
|---|---|---|---|---|
| 5,975,518 | A * | 11/1999 | Wakana et al. | 271/121 |
| 7,029,004 | B2 * | 4/2006 | Asada et al. | 271/124 |
| 7,100,914 | B2 * | 9/2006 | Ramos | 271/124 |
| 7,422,206 | B2 * | 9/2008 | Okuda et al. | 271/124 |
| 7,665,724 | B2 * | 2/2010 | Bingham et al. | 271/124 |
| 7,832,722 | B1 * | 11/2010 | Huang | 271/124 |
| 8,146,912 | B2 * | 4/2012 | Shimazu | 271/121 |
| 2005/0285329 | A1 * | 12/2005 | Ikeda | 271/121 |

FOREIGN PATENT DOCUMENTS

| | | | |
|---|---|---|---|
| JP | 2006-008330 | | 1/2006 |
| JP | 2006008330 | A * | 1/2006 |
| JP | 2006111397 | A * | 4/2006 |
| JP | 2009001366 | A * | 1/2009 |

* cited by examiner

*Primary Examiner* — Gerald McClain
(74) *Attorney, Agent, or Firm* — Banner & Witcoff, Ltd.

(57) ABSTRACT

A sheet feeder includes a sheet tray configured to support one or more sheets stacked thereon in a slanted state, a feed roller disposed to face a lower end of a top one of the sheets stacked on the sheet tray, the feed roller being configured to feed the sheets, a supporter disposed under the sheet tray movably relative to the feed roller, the supporter being configured to support, on an upper surface thereof, lower ends of the sheets stacked on the sheet tray, and a displacement mechanism configured to displace the supporter farther from the feed roller depending on a pressure which the feed roller applies to the sheets when rotating.

20 Claims, 5 Drawing Sheets

SHEET FEEDER HAVING MOVABLE SUPPORTER FOR SUPPORTING SHEETS STACKED ON A SHEET TRAY AND IMAGE RECORDER HAVING THE SAME

CROSS-REFERENCE TO RELATED APPLICATION

This application claims priority under 35 U.S.C. §119 from Japanese Patent Application No. 2009-085701 filed on Mar. 31, 2009. The entire subject matter of the application is incorporated herein by reference.

BACKGROUND

1. Technical Field

The following description relates to one or more sheet feeding techniques for certainly feeding sheets even when a lot of sheets are stacked on a sheet tray.

2. Related Art

A printing device such as a printer and a facsimile machine is provided with a sheet feeder. A sheet feeder has been proposed that has a sheet tray on which sheets are stacked in a state where leading ends of the sheets in a feeding direction are directed obliquely downward (e.g., see US Pre-Grant Publication No. 2005/0285329 A1, teachings of which are incorporated herein by reference). In addition, the sheet feeder has a feed roller disposed to be adjacent to a lower end of the sheet tray. Further, the sheet feeder has a plurality of setting units disposed along an axial direction of the feed roller at a predetermined distance from each other. A sheet, placed on the sheet tray, of which the leading end contacts the setting units, is fed in the feeding direction when the feed roller is driven to rotate. Furthermore, since the setting units are placed to overlap the feed roller when viewed in the axial direction of the feed roller, the setting units, which contact the leading end of the sheet, can prevent the sheet from being inserted between the feed roller and the setting units before the feed roller is driven to rotate.

SUMMARY

According to the aforementioned sheet feeder, the setting units, which the leading end of a sheet contacts, are fixedly disposed to overlap the feed roller when viewed in the axial direction of the feed roller. Therefore, when the number of sheets stacked on the sheet tray increases, the leading ends of top-layer sheets contact not the setting units but the feed roller.

When the feed roller is rotated, a sheet with the leading end thereof in contact with the feed roller is pressed and deformed by the feed roller, and thus inserted between the feed roller and the setting units. However, when a lot of sheets are stacked on the sheet tray, the leading ends of many of the sheets come into contact with the feed roller. It results in an increased number of sheets that are inserted between the feed roller and the setting units due to rotation of the feed roller.

Hence, a pressure which the feed roller applies to the inserted sheets increases, and thus a frictional force generated between any adjacent two of the pressed sheets rises. Thereby, depending on the level of the pressure which the feed roller applies to the sheets, a top one of the sheets might not be separated from a sheet that is beneath and in contact with the top sheet or pass between the feed roller and the setting units. Therefore, in such a situation, the feed roller might feed no sheet while slipping on the top sheet, or feed one or more sheets together with the top sheet. Thus, when a lot of sheets are stacked on the sheet tray, it is unfortunate that the aforementioned sheet feeder might not feed the sheets in a stable and certain manner.

Aspects of the present invention are advantageous to provide one or more improved techniques that make it possible to certainly feed sheets even when a lot of sheets are stacked on a sheet tray.

According to aspects of the present invention, a sheet feeder is provided, which includes a sheet tray configured to support one or more sheets stacked thereon in a slanted state, a feed roller disposed to face a lower end of a top one of the sheets stacked on the sheet tray, the feed roller being configured to feed the sheets, a supporter disposed under the sheet tray movably relative to the feed roller, the supporter being configured to support, on an upper surface thereof, lower ends of the sheets stacked on the sheet tray, and a displacement mechanism configured to displace the supporter farther from the feed roller depending on a pressure which the feed roller applies to the sheets when rotating.

According to aspects of the present invention, further provided is an image recorder that includes a sheet feeder configured to feed a sheet, and a recoding unit configured to record an image on the sheet fed by the sheet feeder. The sheet feeder includes a sheet tray configured to support one or more sheets stacked thereon in a slanted state, a feed roller disposed to face a lower end of a top one of the sheets stacked on the sheet tray, the feed roller being configured to feed the sheets, a supporter disposed under the sheet tray movably relative to the feed roller, the supporter being configured to support, on an upper surface thereof, lower ends of the sheets stacked on the sheet tray, and a displacement mechanism configured to displace the supporter farther from the feed roller depending on a pressure which the feed roller applies to the sheets when rotating.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Figure 1:
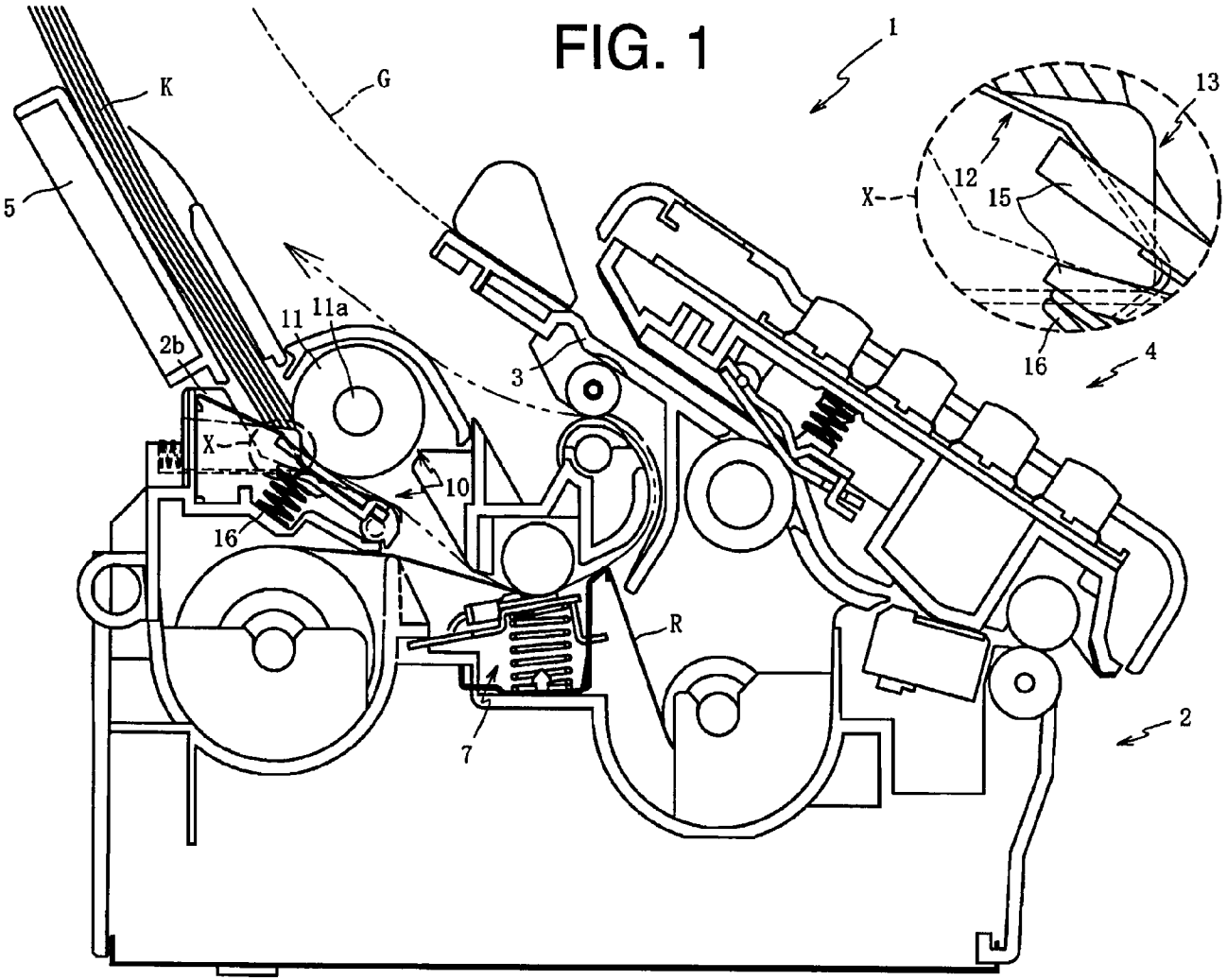
FIG. 1 is a cross-sectional side view showing an internal configuration of a facsimile machine in an embodiment according to one or more aspects of the present invention.

Hereinafter, an embodiment according to aspects of the present invention will be described with reference to the accompany drawings. In FIG. 1, a document sheet G is indicated by a chain double-dashed line, and a feeding path of recording sheets K is indicated by a chain double-dashed arrow. Further, a region X is shown in an enlarged manner.

Initially, referring to FIG. 1, an explanation will be provided about a configuration of a facsimile machine 1 in an embodiment according to aspects of the present invention. The facsimile machine 1 reads an image from the document sheet G, and transmits image data of the read image as facsimile data to another facsimile machine via a communication line such as a telephone line. Further, the facsimile machine 1 receives facsimile data from another facsimile machine via the communication line, and forms an image based on the facsimile data on a recording sheet K. The facsimile machine 1 includes a main body 2 of which an upper side is open, and an upper cover 3 attached to the main body in a vertically rotatable manner so as to cover the upper side of the main body 2. The facsimile machine 1 further includes an operation panel 4 disposed on an upper surface of the upper cover 3, and a sheet feeder 10 that has a sheet tray 5 on which one or more recording sheets K are stacked in a slanted state and feeds the recording sheets K on the sheet tray 5. The facsimile machine 1 further includes a printing unit 7 that performs printing on a recording sheet K fed by the sheet feeder 10 using an ink-ribbon R.

The main body 2 has attachment recessed portions 2*a* (see FIG. 2A) recessed from an upper surface of the main body 2, a plate-spring container 2*b* provided in a protruding manner so as to face a below-mentioned feed roller 11, and recessed portions 2*c* (see FIG. 2B) disposed on both sides of the plate-spring container 2*b*.

The sheet tray 5 is configured to receive the recording sheets K stacked thereon in a slanted state. The sheet tray 5 is detachably attached to the main body 2 with insertion parts (not shown) protruding from the sheet tray 5 being inserted into the attachment recessed portions 2*a* (see FIGS. 2A and 2B). It is noted that there is a gap between the sheet tray 5 and a bottom one of the recording sheets K placed on the sheet tray 5.

Figure 2A:
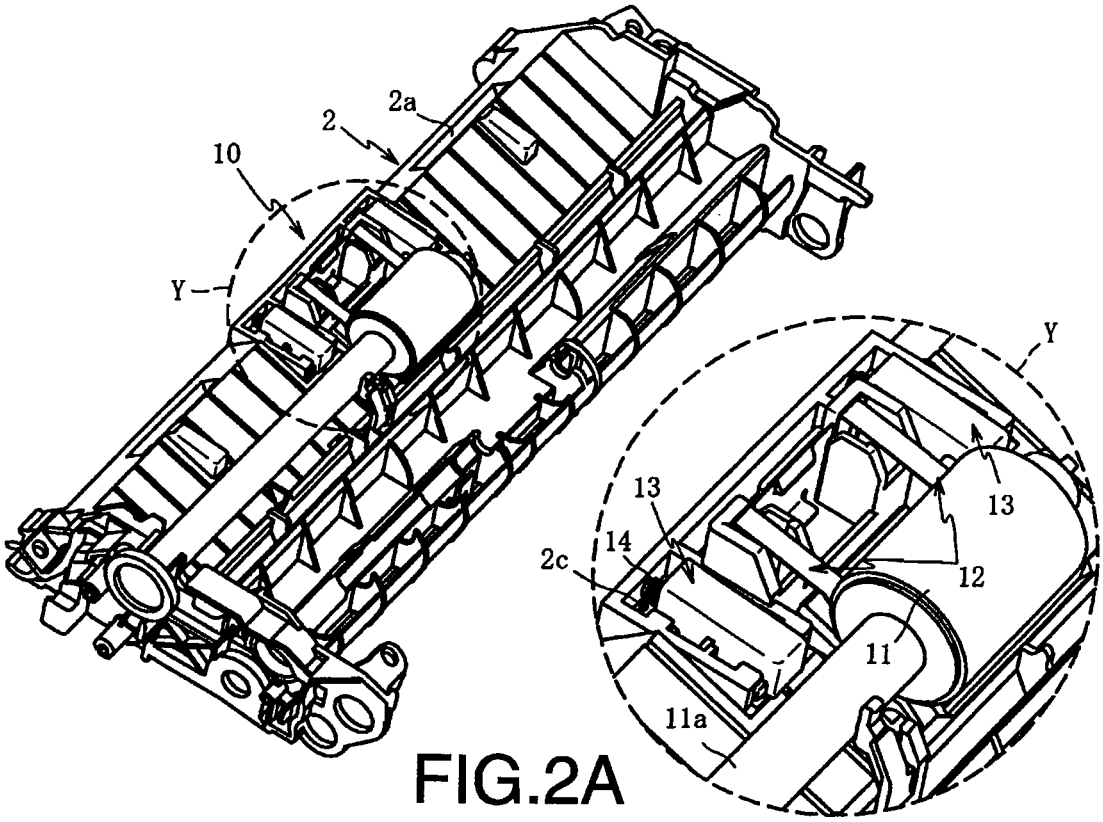
FIG. 2A is a perspective view showing a configuration of a sheet feeder which has a feed roller and set tables attached thereto in the embodiment according to one or more aspects of the present invention.

Subsequently, the sheet feeder 10 will be described in detail with reference to FIGS. 2A and 2B. A region Y in FIG. 2A is shown separately in an enlarged manner. Further, in FIG. 2B, a part of the main body 2 is not shown, and below-mentioned coil springs 14 and set tables 13 are shown in an exploded fashion.

The sheet feeder 10 includes the aforementioned sheet tray 5 (see FIG. 1), the feed roller 11 disposed to face a top one of the recording sheets K (see FIG. 1) stacked on the sheet tray 5 in a slanted state. The sheet feeder 10 further includes a pair of plate springs 12 disposed to face the feed roller 11, a pair of set tables 13 disposed on both sides of the pair of plate springs 12 under the sheet tray 5 (on a lower side in FIG. 2A), and the recessed portions 2*c* in which the pair of set tables 13 are placed. The sheet feeder 10 further includes the coil springs 14 respectively joined with the set tables 13, and a separation pad 15 that is disposed beneath the feed roller 11 and urged by a spring 16 (see FIG. 1) against a circumferential surface of the feed roller 11.

As illustrated in FIG. 2A, the feed roller 11, configured to feed the recording sheets K (see FIG. 1), is rotatably supported by the main body 2 through a rotational shaft 11*a* supported by the main body 2.

Figure 2B:
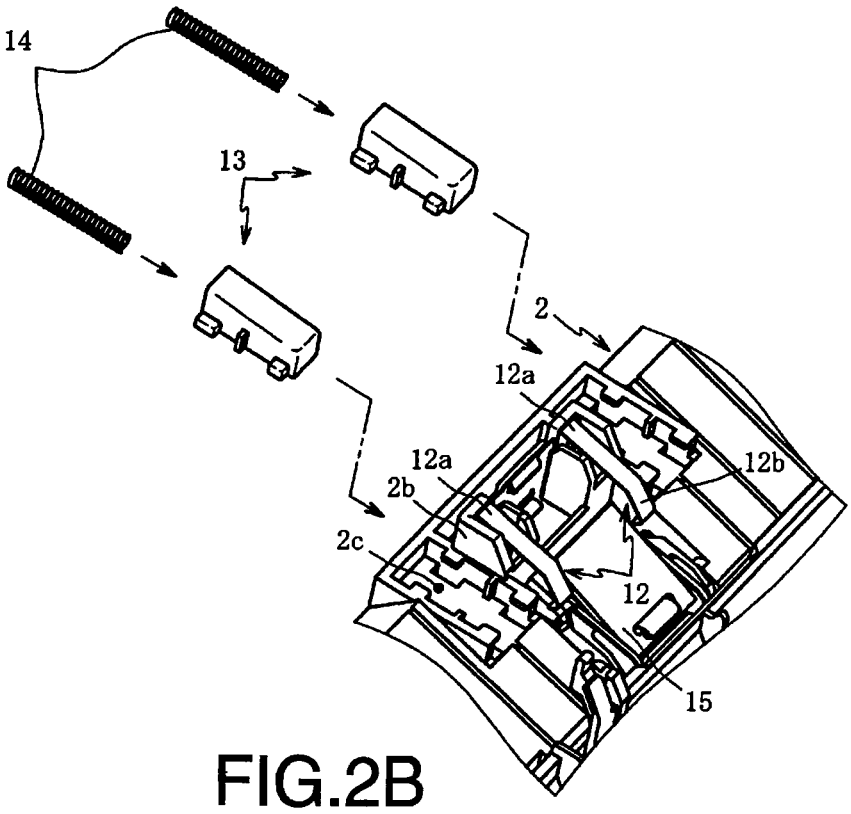
FIG. 2B is a perspective view showing a configuration of the sheet feeder from which the feed roller and the set tables are detached in the embodiment according to one or more aspects of the present invention.

As shown in FIG. 2B, the plate springs 12 are placed to be symmetric with respect to a center line L1 (see FIG. 3A) that is perpendicular to the rotational shaft 11*a* and set with the same distance from each of both side end surfaces of the feed roller 11. Further, the plate springs 12 are housed in the plate-spring container 2*b* such that a downstream side of each plate spring 12 in a sheet feeding direction is swingable around an upstream side of the plate spring 12 in the sheet feeding direction. Additionally, each of the plate springs 12 has a guide portion 12*a* and an extending portion 12*b*. The guide portion 12*a* is more slanted than the upper surfaces of the set tables 13 downward from an upstream end (fixed end) of each plate spring 12. The extending portion 12*b* is configured to extend from the guide portion 12*a* downstream in the sheet feeding direction in a manner more slanted than the guide portion 12*a*.

When a large number (e.g., more than 50) of recording sheets K (see FIG. 1) are stacked, the guide portion 12*a* of each plate spring 12 is bent down (downward in FIG. 2B) due to the weight of the recording sheets K. Therefore, the leading ends of the recording sheets K contact the upper surfaces of the set tables 13 which surfaces are not so slanted. Owing to the weight of the recording sheets K, one or more top-layer sheets of the recording sheets K are pressed against the feed roller 11 (rightward in FIG. 2A) and fed by rotation of the feed roller 11. Meanwhile, when a small number (e.g., several sheets) of recording sheets K (see FIG. 1) are stacked, the guide portion 12*a* of each plate spring 12 is lifted back upward, and the leading ends of the recording sheets K contact the guide portion 12*a* of each plate spring 12. Thereby, the top-layer recording sheets K are urged by the guide portion 12*a* of each plate spring 12 against the feed roller 11. Thus, even when the number of the recording sheets K decreases, the top-layer recording sheets K are pressed against the feed roller 11 and fed due to rotation of the feed roller 11. Accordingly, depending on the number of the recording sheets K stacked, the upper surfaces of the set tables 13 or the guide portions 12*a* of the plate springs 12 appropriately functions to avoid an undesirable situation where a recording sheet K is not fed. Namely, it is possible to feed the recording sheets K in a stable and certain manner despite a change in the number of the recording sheets K stacked.

The set tables 13 are box-shaped members configured to support the lower ends of the recording sheets K (see FIG. 1) with the upper surfaces of the set tables 13. The set tables 13 are placed in the recessed portions 2*c* with the coil springs 14 respectively housed in the set tables 13. Thereby, the set tables 13 are configured to be movable owing to the coil springs 14. In order to place the set tables 13 in the recessed portions 2*c*, as shown in FIG. 2B, the coil springs 14 are incorporated into the set tables 13, respectively. Then, the set tables 13 with the coil springs 14 compressed therein are inserted into the recessed portions 2*c* from above the main body 2 (from an upper side in FIGS. 2A and 2B).

As illustrated in FIG. 2A, when the set tables 13 with the coil springs 14 incorporated therein are inserted and disposed in the recessed portions 2*c* of the main body 2, respectively, the set tables 13 are urged toward the feed roller 11 due to an elastic repulsive forces of the coil springs 14 compressed inside the set tables 13. It is noted that specific configurations of the set tables 13 and the recessed portions 2*c* will be described later with reference to FIGS. 3A to 3D.

As shown in FIG. 2B, the separation pad 15 is configured to separate the recording sheets K on a sheet-by-sheet basis in collaboration with the feed roller 11 and the set tables 13. The separation pad 15 has a rubber member provided on an upper surface thereof that faces the feed roller 11. The rubber member is made of synthetic resin with an optimum surface friction coefficient such as silicon. Further, the separation pad 15 is configured such that an upstream side thereof is swingable around a downstream end thereof (a lower end of the separation pad 15 in FIG. 2B) in the sheet feeding direction of the recording sheets K. Thereby, owing to the feed roller 11 and the separation pad 15, a top one of the recording sheets K to be fed to the printing unit 7 (see FIG. 1) is certainly separated from the other recording sheets K stacked on the sheet tray 5 (see FIG. 1) in a slanted state.

Figure 3A:
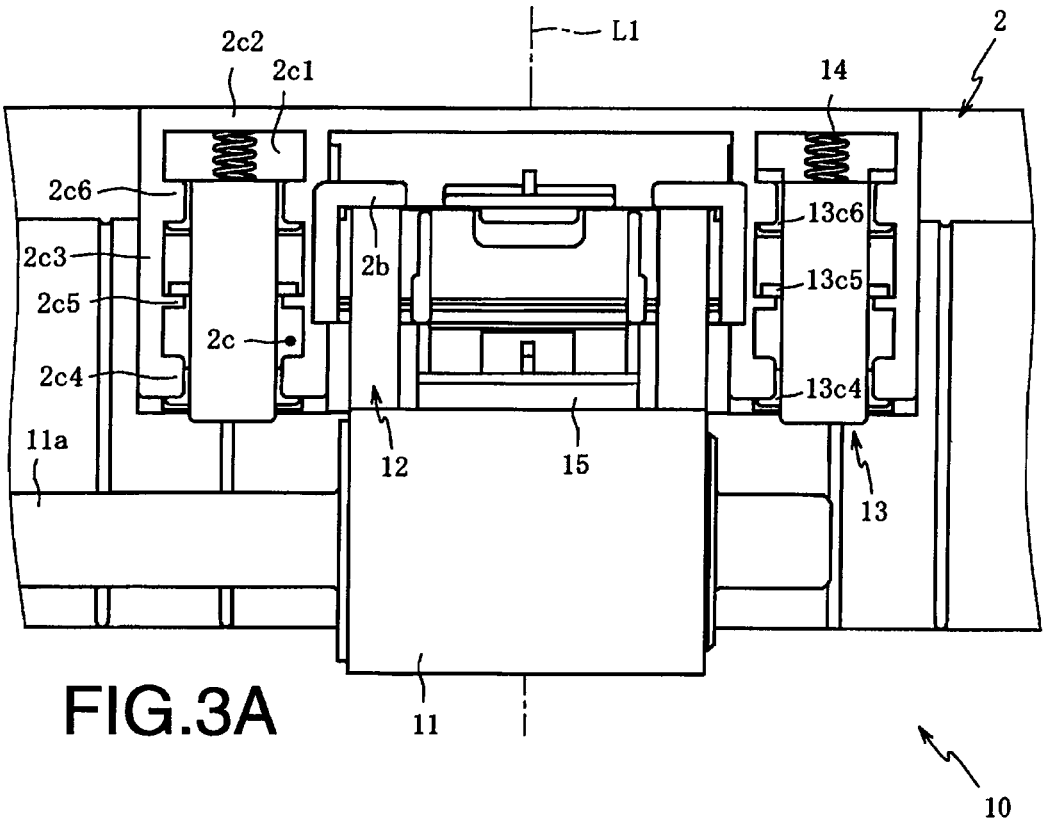
FIG. 3A is a top view showing a main body of the facsimile machine in which each of the set tables is disposed in such an initial position as to overlap the feed roller when viewed in an axial direction of the feed roller in the embodiment according to one or more aspects of the present invention.

Furthermore, referring to FIGS. 3A to 3D and 4A to 4D, the set tables 13 and the recessed portions 2*c* of the main body 2 will be set forth. In FIG. 3A, the center line L1 that is perpendicular to the rotational shaft 11*a* and set with the same distance from each of the both side end surfaces of the feed roller 11 is shown by a dashed line. Further, in each of FIGS. 4A to 4D, an axial line L2 that passes through an axis center O1 of the feed roller 11 is shown by a dashed line.

As illustrated in FIG. 3A, the set tables 13 are respectively disposed on both sides of the plate springs 12 so as to be symmetry with respect to the center line L1 of the feed roller 11. As the set tables 13 are configured in the same manner, hereinafter, an explanation will be provided about one of the two set tables 13, and an explanation about the other set table 13 will be omitted.

Figure 3B:
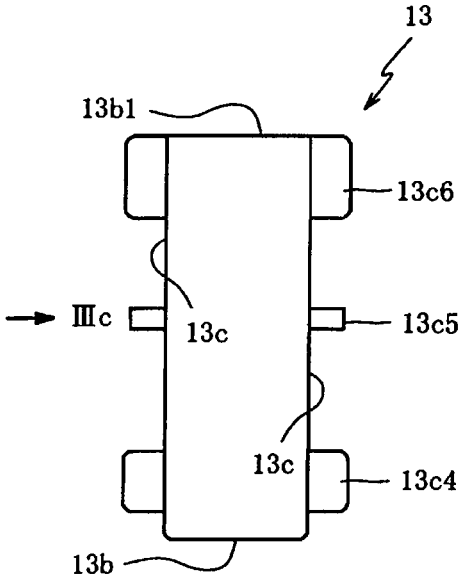
FIG. 3B is a top view showing one of the set tables in the embodiment according to one or more aspects of the present invention.
Figure 3C:
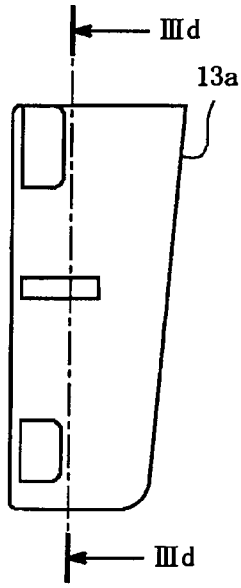
FIG. 3C is a side view of the set table when viewed in a direction IIIc indicated in FIG. 3B in the embodiment according to one or more aspects of the present invention.
Figure 3D:
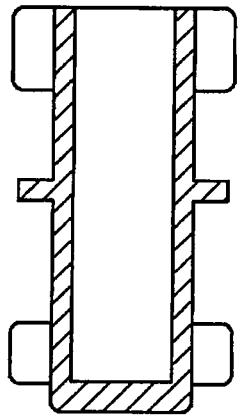
FIG. 3D is a cross-sectional top view of the set table along a line IIId-IIId indicated in FIG. 3C in the embodiment according to one or more aspects of the present invention.

As illustrated in FIGS. 3B to 3D, the set table 13 is formed with an upper wall 13*a*, a side wall 13*b*, and a pair of mutually-facing walls 13*c*. The upper wall 13*a* supports the lower ends (leading ends) of the recording sheets K. The mutually-facing walls 13*c* extend down along the up-to-down direction from both side ends of the upper wall 13*a* in the axial direction of the rotational shaft 11*a* (in a left-to-right direction in FIG. 3A), respectively. The side wall 13*b* extends down along the up-to-down direction from an end of the upper wall 13*a* on the side of the feed roller 11, and forms a connection between the mutually-facing walls 13*c*. In addition, the set table 13 has an opening 13*b*1 formed at a side facing the side wall 13*b*.

As illustrated in FIGS. 3A to 3D, the mutually-facing wall 13*c* are configured in the same manner. Specifically, each of the mutually-facing walls 13*c* has a plurality of ribs 13*c*4, 13*c*5, and 13*c*6 that protrude in the axial direction of the rotational shaft 11*a* of the feed roller 11 (in the left-to-right direction in FIG. 3A). The plurality of ribs 13*c*4, 13*c*5, and 13*c*6 includes front ribs 13*c*4 disposed the closest to the feed roller 11, rear ribs 13*c*6 disposed the farthest from the feed roller 11, and intermediate ribs 13*c*5 disposed between the front ribs 13*c*4 and the rear ribs 13*c*6.

As shown in FIGS. 3A to 3D, each of the front ribs 13*c*4 and the rear ribs 13*c*6 is configured to extend in a longitudinal direction of the set table 13 (in the vertical direction in FIGS. 3A to 3D). Each of the intermediate ribs 13*c*5 extends in the up-to-down direction perpendicular to the longitudinal direction of the set table 13 (in a direction perpendicular to FIGS. 3A, 3B, and 3D). In addition, respective longitudinal lengths of the upper wall 13*a* and the mutually-facing walls 13*c* are shorter than a length of the coil spring 14 in an uncompressed state. Further, when the set table 13 is placed in the recessed portion 2*c* of the main body 2, a gap is formed between the set table 13 and a below-mentioned stand wall 2*c*2 of the recessed portion 2*c*. Therefore, the set table 13 is disposed in the recessed portion 2*c* of the main body 2, movably in the longitudinal direction of the set table 13.

Further, the upper wall 13*a* has an upper surface configured to be slanted down toward the feed roller 11 (downward in FIG. 3A). Therefore, the weight of the recording sheets K (see FIG. 1) supported by the upper wall 13*a* of the set table 13 is applied toward the feed roller 11. Thus, the upper wall 13*a* is configured such that when a top one of the recording sheets K is fed due to rotation of the feed roller 11, a recording sheet K beneath the top recording sheet K moves toward the fed roller 11.

As shown in FIG. 3A, the recessed portion 2*c* of the main body 2, in which the set table 13 is disposed, is formed with a base 2*c*1, a stand wall 2*c*2, and a pair of side vertical walls 2*c*3. The base 2*c*1 is configured such that the set table 13 is placed thereon. The stand wall 2*c*2 is configured to extend up from an end of the base 2*c*1 that faces the feed roller 11 across the base 2*c*1. The side vertical walls 2*c*3 are configured to extend toward the feed roller 11 (downward in FIG. 3A) from both side ends of the stand wall 2*c*2, respectively. The recessed portion 2*c* configured as above is open to the side of the feed roller 11 (the downside in FIG. 3A) and the upside (the near side of FIG. 3A).

Each of the side vertical walls 2*c*3 is disposed to face a corresponding one of the mutually-facing walls 13*c*, and provided with a plurality of ribs 2*c*4, 2*c*5, and 2*c*6 protruding from the side vertical wall 2*c*3. Further, the plurality of ribs 2*c*4, 2*c*5, and 2*c*6 include a front pressing rib 2*c*4 disposed the closest to the feed roller 11, a rear pressing rib 2*c*6 disposed the farthest from the feed roller 11, and an intermediate engagement rib 2*c*5 disposed between the front pressing rib 2*c*4 and the rear pressing rib 2*c*6. The front pressing rib 2*c*4 and the rear pressing rib 2*c*6 extend in the longitudinal direction of the set table 13 (in the vertical direction in FIG. 3A). The intermediate engagement rib 2*c*5 extends along the up-to-down direction (in a direction perpendicular to FIG. 3A), which is perpendicular to the longitudinal direction of the set table 13, from a lower end to an upper end of the side vertical wall 2*c*3.

As illustrated in FIG. 3A, the set table 13 with the coil spring 14 incorporated and compressed therein is inserted into the recessed portion 2*c* of the main body 2 from above the main body 2 (from the near side of FIG. 3A), such that the intermediate rib 13*c*5 of the set table 13 is located between the intermediate engagement rib 2*c*5 and the rear pressing rib 2*c*6. When the set table 13 is placed in the recessed portion 2*c* of the main body 2, the coil spring 14 extends such that a front end thereof (a lower end in FIG. 3A) contacts an inner surface of the side wall 13*b* and a rear end thereof (an upper end in FIG. 3A) contacts the stand wall 2*c*2 of the recessed portion 2*c*. Therefore, the set table 13 is urged by the coil spring 14 toward the feed roller 14.

Movement of each set table 13, which is urged toward the feed roller 11, is regulated by engagement between the intermediate ribs 13*c*5 and the intermediate engagement ribs 2*c*5. Thus, the set table 13 is disposed in such an initial position as to overlap the feed roller 11 when viewed in the axial direction of the feed roller 11. Hence, in a state where the set table 13 is placed in the initial position, the lower end of a recording sheet K is prevented from being inserted between the feed roller 11 and the set table(s) 13.

Further, when the set table 13 is placed in the initial position, the front ribs 13*c*4 and the rear ribs 13*c*6 are disposed to overlap the front pressing ribs 2*c*4 and the rear pressing ribs 2*c*6, respectively, in the up-to-down direction (in a direction perpendicular to FIG. 3A). Therefore, even though a someone attempts to detach the set table 13, which is urged toward the feed roller 11 (downward in FIG. 3A), from the recessed portion 2*c* of the main body 2, the front ribs 13*c*4 and the rear ribs 13*c*6 interfere with the front pressing ribs 2*c*4 and the rear pressing ribs 2*c*6, respectively. Thus, the set table 13 cannot be detached from the recessed portion 2*c* of the main body 2. Accordingly, it is possible to prevent the set table 13, which is urged toward the feed roller 11, from being detached from the recessed portion 2*c* of the main body 2.

Meanwhile, when the coil spring 14 is compressed and the set table 13 is moved in such a direction as to be farther from the feed roller 11 (upward in FIG. 3A), the front ribs 13*c*4 and the rear ribs 13*c*6 are located so as not to overlap the front pressing ribs 2*c*4 or the rear pressing ribs 2*c*6 in the up-to-down direction. Thereby, since the set table 13 can be detached from the recessed portion 2*c* of the main body 2, maintenance such as replacement of the coil spring 14 can easily be done.

Referring to FIGS. 4A to 4D, an explanation will be provided about movement of the set table 13 due to expansion and contraction of the coil spring 14. As shown in FIGS. 4A to 4D, the set table 13 is configured, as mentioned above, to be movable in the longitudinal direction of the set table 13 (in the left-to-right direction in FIGS. 4A to 4D) due to expansion and contraction of the coil spring 14.

Figure 4A:
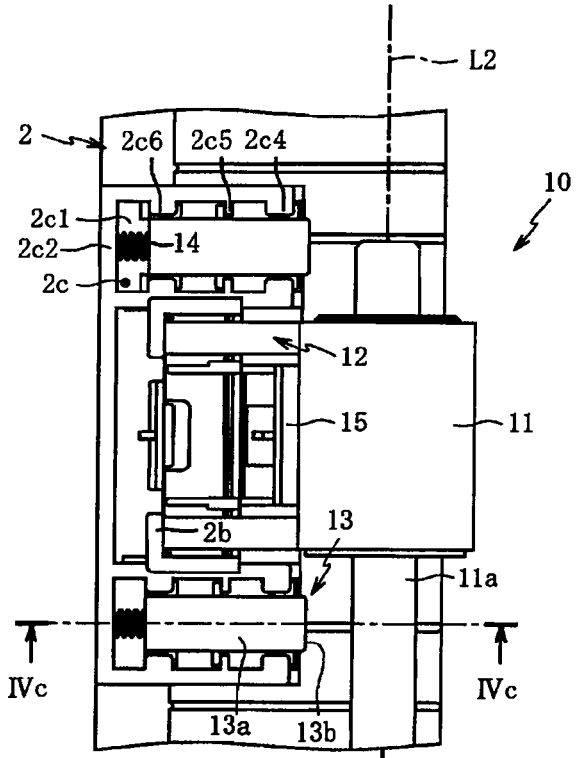
FIG. 4A is a top view of the facsimile machine in which each of the set tables is located in the initial position in the embodiment according to one or more aspects of the present invention.
Figure 4B:
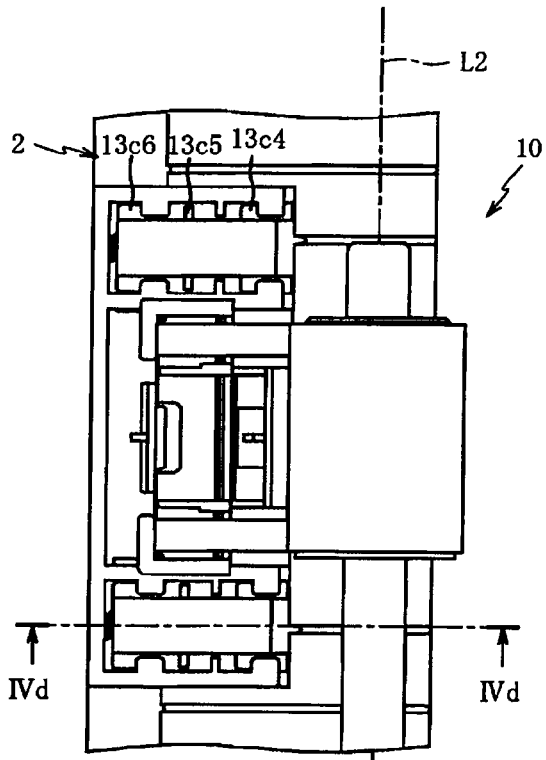
FIG. 4B is a top view of the facsimile machine in which each of the set tables is displaced from the initial position in such a direction as to be farther from the feed roller in the embodiment according to one or more aspects of the present invention.
Figure 4C:
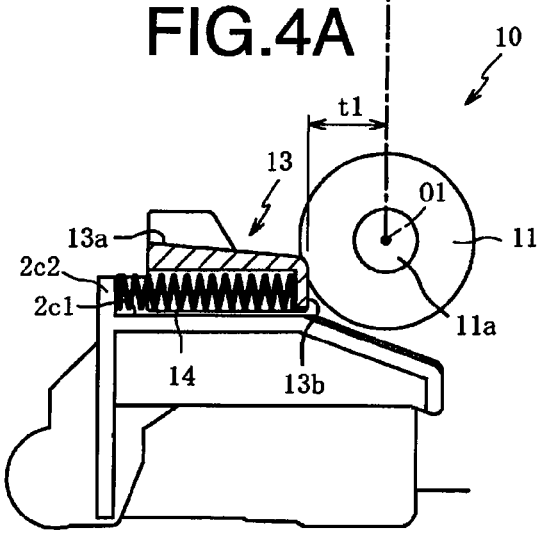
FIG. 4C is a cross-sectional side view of the facsimile machine along a line IVc-IVc indicated in FIG. 4A in the embodiment according to one or more aspects of the present invention.

As illustrated in FIGS. 4A and 4C, when each set table 13 is inserted and disposed in the recessed portion 2*c* of the main body 2, the set table 13 is moved and urged toward the feed roller 11 (rightward in FIG. 4A) due to expansion of the coil spring 14. The set table 13, which is urged toward the feed roller 11, is positioned by contact and engagement between the intermediate ribs 13*c*5 and the intermediate engagement ribs 2*c*5, and disposed in the initial position where a front end of the set table 13 overlaps the feed roller 11 when viewed in the axial direction of the feed roller 11. Thus, each of the set tables 13 is disposed with a distance t1 between the set table 13 and the axis center O1 of the rotational shaft 11*a* of the fed roller 11.

Figure 4D:
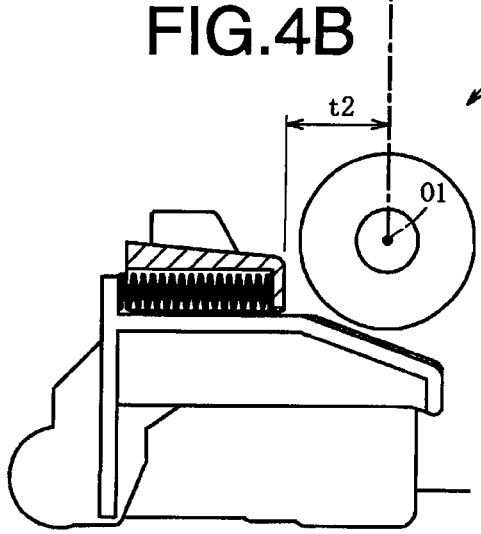
FIG. 4D is a cross-sectional side view of the facsimile machine along a line IVd-IVd indicated in FIG. 4B in the embodiment according to one or more aspects of the present invention.

Meanwhile, as shown in FIGS. 4B and 4D, when the feed roller 11 is rotated, the coil spring 14 incorporated in each of the set tables 13 is compressed, and the set table 13 is moved in the direction to be farther from the feed roller 11 (leftward in FIG. 4D). The set table 13, which is moved to be farther from the feed roller 11, is disposed with a distance t2 between the set table 13 and the axis center O1 of the rotational shaft 11*a* of the feed roller 11 so as to form a gap between the side wall 13*b* of the set table 13 and the feed roller 11 when viewed in the axial direction of the rotational shaft 11*a*.

As shown in FIGS. 4A to 4D, in the embodiment, not the feed roller 11 but the set tables 13 are moved due to expansion and contraction of the coil springs 14. Therefore, by incorporating the coil spring 14 in each of the set tables 13 and placing the set table 13 in the recessed portion 2*c*, the degree of the overlap between the set table 13 and the feed roller 11 when viewed in the axial direction of the feed roller 11 can be controlled. Accordingly, in the embodiment, it is not required to make a change to a mechanism (not shown) for rotating the feed roller 11 which change would be required for moving the feed roller 11. Thus, it is possible to simplify the configuration of the sheet feeder 10, since the degree of the overlap between the set table 13 and the feed roller 11 when viewed in the axial direction of the feed roller 11 can be controlled with the aforementioned simple configuration, i.e., the coil spring 14 incorporated in each of the set tables 13.

It is possible to move the feed roller 11 relative to the set tables 13. In such a case, however, the feed roller 11 has to be moved while maintaining a rotatable state thereof. It results in a complicated configuration of a mechanism for moving the feed roller 11. On the contrary, each of the set tables 13 is a member disposed in the recessed portion 2*c* of the main body 2 so as to support the recording sheets K (see FIG. 1). Therefore, when the recessed portion 2*c* of the main body 2 is formed longer than the set table 13 in the moving direction of the set table 13, and the coil spring 14 is incorporated in the set table 13, it is possible to adjust the degree of the overlap between the set table 13 and the feed roller 11 when viewed in the axial direction of the feed roller 11. Thus, it is possible to simplify the configuration of the sheet feeder 10, since the degree of the overlap between the set table 13 and the feed roller 11 when viewed in the axial direction of the feed roller 11 can be controlled with the aforementioned simple configuration.

As shown in FIGS. 4A to 4D, in response to the coil spring 14 being compressed, each of the set tables 13 moves from the initial position in the direction to be farther from the feed roller 11. Therefore, a gap equal to or more than a moving distance of the set table 13 is required between the set table 13 and the stand wall 2*c*2. By rendering the gap smaller, it is possible to downsize the base 2*c*1 (the recessed portion 2*c*). However, when the gap is rendered smaller, a space, in which the coil spring 14 for moving the set table 13 is housed, is as well made smaller. It leads to a shorter length of the coil spring 14 and thus to worsened easiness in assembling to incorporate the coil spring 14 into the set table 13.

On the contrary, each of the set tables 13 has an open side that faces the side wall 13*b* and the stand wall 2*c*2, and an end of the coil spring 14 is connected with the inner surface of the side wall 13*b* of the set table 13. Thereby, the coil spring 14 can be housed in the set table 13. Thus, even though the gap between the set table 13 and the stand wall 2*c*2 is configured to be small, the coil spring 14 can be configured to be longer than would be attained when the coil spring 14 is not housed in the set table 13. Accordingly, it is possible to enhance easiness in assembling to incorporate the coil spring 14 into an inner space of the set table 13, along with downsizing the base 2*c*1 (the recessed portion 2*c*).

As illustrated in FIGS. 4A to 4D, when each of the set tables 13, which is moved in the direction to be farther from the feed roller 11 (leftward in FIG. 4A), is moved back to the initial position (rightward in FIG. 4A), the movement of the set table 13 is restricted by contact between the intermediate ribs 13*c*5 and the intermediate engagement ribs 2*c*5, which are located on paths on which the intermediate ribs 13*c*5 move toward the feed roller 11, respectively. Therefore, it is possible to prevent each of the set tables 13 from moving to be closer to the feed roller 11 than the initial position. Thereby, it is possible to prevent the degree of the overlap between the set table 13 and the feed roller 11 when viewed in the axial direction of the feed roller 11 from being larger than that in the initial position of the set table 13. Thus, it is possible to certainly feed the recording sheets K (see FIG. 1) with the feed roller 11.

Referring to FIGS. 5A to 5D, an explanation will be provided about how the recording sheets K are fed, which are stacked in a slanted state on the sheet tray 5 (see FIG. 1). It is noted that in FIG. 5D, one or more top-layer sheets of the recording sheets K is only shown, and the other recording sheets K are not shown.

Figure 5A:
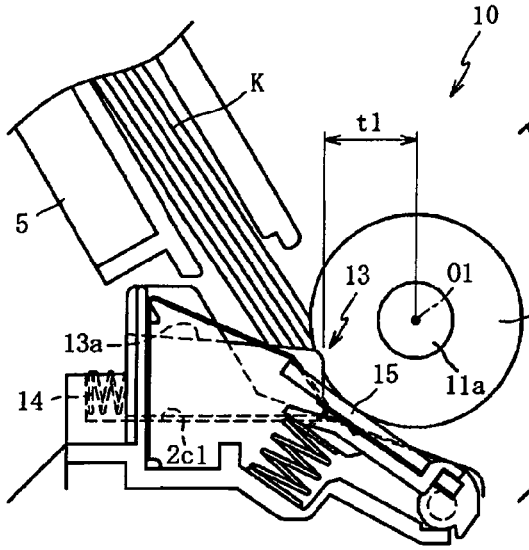
FIG. 5A is a cross-sectional side view of the sheet feeder before beginning to feed recording sheets in the embodiment according to one or more aspects of the present invention.

As shown in FIG. 5A, when a lot of recording sheets K (e.g., about 100 sheets) are stacked on the sheet tray 5 (see FIG. 1), the lower ends (leading ends) of the top-layer ones of the recording sheets K stacked in a slanted state on the sheet tray 5 contact not the upper wall 13*a* of each of the set tables 13 but the feed roller 11. Even in such a situation, since each of the set tables 13 is urged by the coil spring 14 toward the feed roller 11, the set table 13 is placed in the recessed portion 2*c* of the main body 2 so as not to move in the direction to be farther from the feed roller 11. Further, each of the set tables 13 is configured to move in the direction to be farther from the feed roller 11 in response to the coil spring 14 being compressed by a pressure which the feed roller 11 applies to the recording sheets K when rotating.

In the case where each of the set tables 13 is fixed as a known configuration, when the feed roller 11 is rotated with the lower ends of the top-layer recoding sheets K in contact with the feed roller 11, the pressure which the feed roller applies to the top-layer recording sheets K increases. Thus, a frictional force, which is generated between any adjacent two of the pressed recording sheets K, rises concurrently. Thereby, depending on the level of the pressure which the feed roller 11 applies to the top-layer recording sheets K, a top one of the recording sheets K might not be separated from a sheet beneath the top recording sheet K or pass between the feed roller 11 and the set tables 13. Therefore, in such a situation, the feed roller 11 might feed no sheet while slipping on the top recording sheet K, or feed one or more sheets together with the top recording sheet K.

Figure 5B:
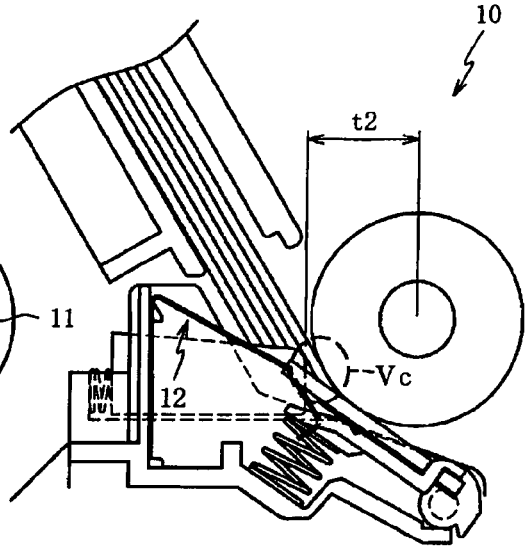
FIG. 5B is a cross-sectional side view of the sheet feeder which is ready to feed a top one of the recording sheets in the embodiment according to one or more aspects of the present invention.

On the contrary, in the embodiment, as described above, each of the set tables 13 is configured with the coil spring 14 incorporated therein, so as to move depending on the pressure which the feed roller 11 applies to the recording sheets K along with rotation of the feed roller 11. Therefore, as shown in FIG. 5B, when the feed roller 11 is rotated counterclockwise in the figure, the coil spring 14 incorporated in the set table 13 is compressed due to the pressure which the feed roller 11 applies to the recording sheets K along with rotation of the feed roller 11.

Figure 5C:
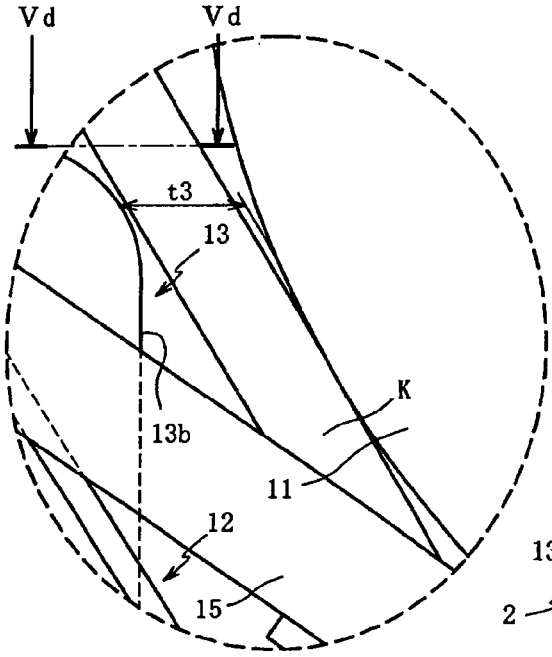
FIG. 5C is an enlarged cross-sectional side view of a region Vc indicated in FIG. 5B in the embodiment according to one or more aspects of the present invention.
Figure 5D:
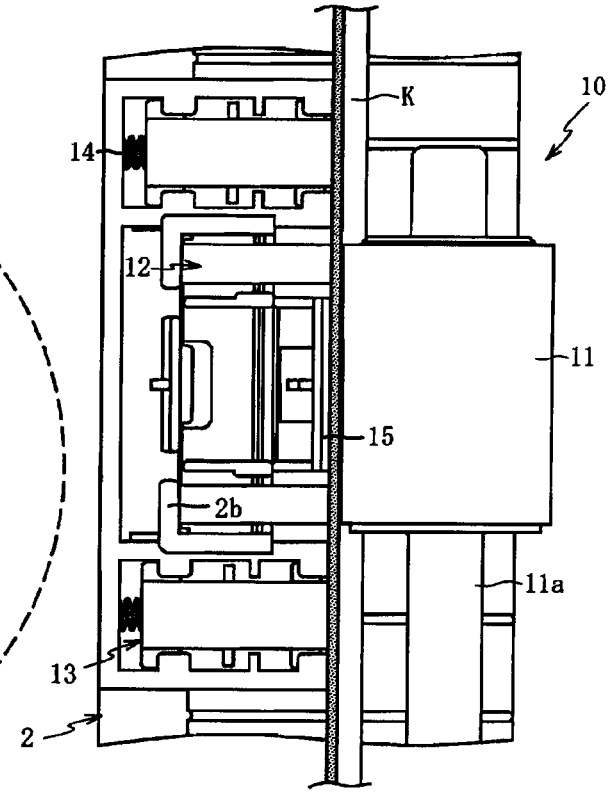
FIG. 5D is an cross-sectional top view of the sheet feeder along a line Vd-Vd indicated in FIG. 5C in the embodiment according to one or more aspects of the present invention.

In response to the coil spring 14 being compressed, each of the set tables 13 is moved in the direction to be farther from the feed roller 11 (leftward in FIG. 5D). Thereby, a gap is generated between the set table 13 and the feed roller 11 with no overlap therebetween when viewed in the axial direction of the feed roller 11. Thus, as illustrated in FIG. 5C, the side wall 13*b* of the set table 13 is located a (horizontal) distance t3 away from the feed roller 11. Further, along with the movement of each of the set tables 13, the recording sheets K, of which the lower ends are supported by the set table 13, are moved in the direction to be farther from the feed roller 11. Hence, the aforementioned gap between a bottom one of the recording sheets K and the sheet tray 5 substantially disappears, and the bottom recording sheet K contacts the sheet tray 5.

As shown in FIG. 5C, the top-layer recording sheets K (including the top recording sheet K in contact with the feed roller 11) are inserted in a gap between the side wall 13*b* of each set table 13 and the feed roller 11 placed the distance t3 away from the side wall 13*b*. As illustrated in FIG. 4D, the top-layer recording sheets K are inserted in the gap between the feed roller 11 and the set tables 13 with less deformation than would be attained when the set tables 13 are fixed. Thus, the pressure which the feed roller 11 applies to the recording sheets K is rendered less than would be attained when the set tables 13 are fixed.

Thereby, since the frictional force generated between any adjacent two of the pressed recording sheets K is rendered less as well, the top recording sheet K can be separated from a sheet beneath the top recording sheet K. Consequently, even though a lot of recording sheets K are stacked on the sheet tray 5, it is possible to prevent the feed roller 11 from feeding no recording sheet K while slipping on the top recording sheet K or feeding one or more sheets together with the top recording sheet K. Thus, it is possible to certainly feed the recording sheets K with the feed roller 11 sequentially on a sheet-by-sheet basis.

Further, when the recording sheets K are thicker sheets (which are harder to deform) than normal sheets, the recording sheets K could not successfully be deformed or inserted between the feed roller 11 and the set tables 13 under an assumption that the set tables 13 remain in their respective initial positions. In contrast, in the embodiment, each of the set tables 13 can be moved by the coil spring 14 from the initial position in the direction to be farther from the feed roller 11, depending on the pressure which the feed roller 11 applies the recording sheets K when rotating. Thereby, the degree of the overlap between the set table 13 and the feed roller 11 when viewed in the axial direction of the feed roller 11 is reduced, and a gap is generated therebetween. Thus, the recording sheets K can be inserted between the feed roller 11 and the set table 11 without having to be deformed. Accordingly, even though the recording sheets K are thick, it is possible to prevent the feed roller 11 from feeding no recording sheet K and thus certainly feed the recording sheets K with the feed roller 11.

As shown in FIGS. 5A and 5B, each of the set tables 13 is moved by the coil spring 14 (in response to the coil spring 14 being compressed) from the initial position in the direction to be farther from the feed roller 11 (leftward in FIGS. 5A and 5B), depending on the pressure which the feed roller 11 applies to the recording sheets K when rotating. When the aforementioned pressure becomes less than an elastic restoring force of the coil spring 14, the set table 13 is moved by the elastic restoring force of the coil spring 14 back to the initial position to overlap the feed roller 11 when viewed in the axial direction of the feed roller 11. Namely, as the set table 13 is moved by the elastic restoring force of the coil spring 14 back to the initial position, any specific mechanism is not required to be separately prepared for moving the set table 13, which is displaced to be farther from the feed roller 11, back to the initial position. Thus, the configuration of the sheet feeder 10 can be simplified as a whole.

Further, according to the sheet feeder 10 in the embodiment, even when a lot of recording sheets K are stacked on the sheet tray 5 (see FIG. 1), it is possible to prevent the feed roller 11 from feeding no recording sheet K or feeding one or more sheets together with the top recording sheet K. Thus, it is possible to certainly feed the recording sheets K with the feed roller 11. Furthermore, since as images are formed on the certainly-fed recording sheets K with the printing unit 7 (see FIG. 1), it is possible to obtain high-quality images formed by the printing unit 7.

A recording sheet K in contact with the feed roller 11 can be inserted between the feed roller 11 and the set tables 13 when the recording sheet K can move relative to the set tables 13. However, when a lot of recording sheets K (e.g., 100 sheets) are stacked on the sheet tray 5 (see FIG. 1), the frictional force between the lower ends of the recording sheets K and the upper walls 13*a* of the set tables 13 is more than the pressure which the feed roller 11 applies to the recording sheets K. In such a situation, the recording sheets K cannot move relative to the set tables 13, and thus it is impossible to displace a recording sheet K in contact with the feed roller 11 in the direction to be farther from the feed roller 11 (see leftward in FIG. 5A). On the contrary, in the embodiment, each of the set tables 13 has the coil spring 14 connected therewith. When the pressure, which the feed roller 11 applies to the recording sheets K along with rotation of the feed roller 11, is more than the elastic restoring force of the coil spring 14, each of the set tables 13 is moved in the direction to be farther from the feed roller 11. Therefore, even though the recording sheets K cannot move relative to the set tables 13, it is possible to insert a recording sheet K in contact with the feed roller 11 between the feed roller 11 and the set tables 13.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible.

In the aforementioned embodiment, the coil spring 14 is housed in each of the set tables 13. However, the coil spring 14 may be disposed outside each of the set tables 13.

In the aforementioned embodiment, each of the set tables 13 is configured to move in the direction to be farther from the feed roller 11. However, the feed roller 11 may be configured to move in such a direction as to be farther from the set tables 13.

In the aforementioned embodiment, the sheet feeder 10 is applied to the facsimile machine 1. However, the sheet feeder 10 may be applied to other devices such as a printer.

In the aforementioned embodiment, each of the set tables 13 is disposed in the initial position to overlap the feed roller 11 when viewed in the axial direction of the feed roller 11. However, each of the set tables 13 may be disposed in such an initial position as to have a gap between the feed roller 11 and the set tables 13. In this case, by movement of the set tables 13, the gap between the feed roller 11 and each set table 13 is rendered larger than that in the initial position. Hence, two or more recording sheets K may be fed along with rotation of the feed roller 11. However, each of the coil springs 14 is configured to apply such an appropriate urging force that the fed recording sheets K are finally separated by the reparation pad 15 on a sheet-by-sheet basis. Thus, it is possible to certainly prevent the feed roller 11 from feeding no recording sheet K or concurrently feeding two or more recording sheets K.

In the aforementioned embodiment, the set tables 13 are configured to support the recording sheets K stacked on the sheet tray 5 in a slanted state. However, the set tables 13 may be configured to support a document sheet G placed on a document table in order to read an image from the document sheet G. In this case, it is possible to certainly prevent the feed roller 11 from feeding no document sheet G or concurrently feeding two or more document sheets G in reading images with a reading unit. Thus, such a configuration makes it possible to acquire all the images to be read without failure.

What is claimed is:

1. A sheet feeder comprising:

a sheet tray configured to support one or more sheets stacked thereon in a slanted state relative to a horizontal direction;

a feed roller disposed to face a lower end of a top one of the one or more sheets stacked on the sheet tray, the feed roller being configured to rotate to feed the one or more sheets;

a supporter entirely spaced apart from the feed roller in an axial direction of the feed roller and movably disposed to only translate, relative to the feed roller, under the sheet tray, the supporter being configured to support, on an upper surface thereof, lower ends of the one or more sheets stacked on the sheet tray; and a displacement mechanism configured to displace the supporter farther from the feed roller depending on a pressure applied by the feed roller to the one or more sheets when the feed roller is rotating around a rotational center axis of the feed roller.

2. The sheet feeder according to claim 1, wherein the displacement mechanism comprises an elastic member configured to be compressed in a predetermined direction to displace the supporter farther from the feed roller depending on the pressure applied by the feed roller to the one or more sheets when rotating.

3. The sheet feeder according to claim 2, further comprising:

a base on which the supporter is placed; and a stand wall that extends upwardly from an end of the base that faces the feed roller across the base, wherein the supporter comprises:

a side wall that extends downwardly from an end of the upper surface on a side of the feed roller; and an opening formed at a side facing the side wall and the stand wall, and wherein the elastic member has a first end connected with the stand wall and a second end connected with an inner surface of the side wall.

4. The sheet feeder according to claim 1, further comprising a regulator disposed on a path on which the supporter is displaced by the displacement mechanism, the regulator being configured to regulate movement of the supporter toward the feed roller by contact with the supporter.

5. The sheet feeder according to claim 1, wherein the supporter is movably disposed in an initial position where the supporter overlaps the feed roller when viewed in the axial direction of the feed roller.

6. The sheet feeder according to claim 1,
wherein the supporter comprises a plurality of set tables, each of which is movably disposed under the sheet tray at a predetermined distance from each other in the axial direction of the feed roller and configured to support, on an upper surface thereof, the lower ends of the one or more sheets stacked on the sheet tray, and
wherein the displacement mechanism is configured to displace each of the set tables farther from the feed roller depending on the pressure applied by the feed roller to the one or more sheets when rotating.

7. The sheet feeder according to claim 6,
wherein the displacement mechanism comprises an elastic member configured to be compressed in a predetermined direction to displace each of the set tables farther from the feed roller depending on the pressure applied by the feed roller to the one or more sheets when rotating.

8. The sheet feeder according to claim 7, further comprising:
a base on which each of the set tables is placed; and
a stand wall that extends up from an end of the base that faces the feed roller across the base,
wherein each of the set tables comprises:
a side wall that extends downwardly from an end of the upper surface on a side of the feed roller; and
an opening formed at a side facing the side wall and the stand wall, and
wherein the elastic member has a first end connected with the stand wall and a second end connected with an inner surface of the side wall.

9. The sheet feeder according to claim 6, further comprising a regulator disposed on a path on which each of the set tables is displaced by the displacement mechanism, the regulator being configured to regulate movement of each of the set tables toward the feed roller by contact with the set table.

10. The sheet feeder according to claim 6,
wherein each of the set tables is movably disposed in an initial position where the set table overlaps the feed roller when viewed in the axial direction of the feed roller.

11. An image recorder comprising:
a sheet feeder configured to feed a sheet; and
a recoding unit configured to record an image on the sheet fed by the sheet feeder,
wherein the sheet feeder comprises:
a sheet tray configured to support one or more sheets stacked thereon in a slanted state relative to a horizontal direction;
a feed roller disposed to face a lower end of a top one of the one or more sheets stacked on the sheet tray, the feed roller being configured to rotate to feed the one or more sheets;
a supporter entirely spaced apart from the feed roller in an axial direction of the feed roller and movably disposed to only translate, relative to the feed roller, under the sheet tray, the supporter being configured to support, on an upper surface thereof, lower ends of the one or more sheets stacked on the sheet tray; and
a displacement mechanism configured to displace the supporter farther from the feed roller depending on a pressure applied by the feed roller to the one or more sheets when the feed roller is rotating around a rotational center axis of the feed roller.

12. The image recorder according to claim 11,
wherein the displacement mechanism comprises an elastic member configured to be compressed in a predetermined direction to displace the supporter farther from the feed roller depending on the pressure applied by the feed roller to the sheets when rotating.

13. The image recorder according to claim 12,
wherein the sheet feeder further comprises:
a base on which the supporter is placed; and
a stand wall that extends upwardly from an end of the base that faces the feed roller across the base,
wherein the supporter comprises:
a side wall that extend downwardly from an end of the upper surface on a side of the feed roller; and
an opening formed at a side facing the side wall and the stand wall, and
wherein the elastic member has a first end connected with the stand wall and a second end connected with an inner surface of the side wall.

14. The image recorder according to claim 11,
wherein the sheet feeder further comprises a regulator disposed on a path on which the supporter is displaced by the displacement mechanism, the regulator being configured to regulate movement of the supporter toward the feed roller by contact with the supporter.

15. The image recorder according to claim 11,
wherein the supporter is movably disposed in an initial position where the supporter overlaps the feed roller when viewed in the axial direction of the feed roller.

16. The image recorder according to claim 11,
wherein the supporter comprises a plurality of set tables, each of which is disposed under the sheet tray at a predetermined distance from each other in an axial direction of the feed tray and configured to support, on an upper surface thereof, the lower ends of the one or more sheets stacked on the sheet tray, and
wherein the displacement mechanism is configured to displace each of the set tables farther from the feed roller depending on the pressure applied by the feed roller to the sheets when rotating.

17. The image recorder according to claim 16,
wherein the displacement mechanism comprises an elastic member configured to be compressed in a predetermined direction to displace each of the set tables farther from the feed roller depending on the pressure applied by the feed roller to the sheets when rotating.

18. The image recorder according to claim 17,
wherein the sheet feeder further comprises:
a base on which each of the set tables is placed; and
a stand wall that extends upwardly from an end of the base that faces the feed roller across the base,
wherein each of the set tables comprises:
a side wall that extends downwardly from an end of the upper surface on a side of the feed roller; and
an opening formed at a side facing the side wall and the stand wall, and
wherein the elastic member has a first end connected with the stand wall and a second end connected with an inner surface of the side wall.

19. The image recorder according to claim 16,
wherein the sheet feeder further comprises a regulator disposed on a path on which each of the set tables is displaced by the displacement mechanism, the regulator being configured to regulate movement of each of the set tables toward the feed roller by contact with the set table.

20. The image recorder according to claim 16,
wherein each of the set tables is movably disposed in an initial position where the set table overlaps the feed roller when viewed in the axial direction of the feed roller.

* * * * *